US010856642B1

(12) United States Patent
Spell

(10) Patent No.: US 10,856,642 B1
(45) Date of Patent: Dec. 8, 2020

(54) UNIVERSALLY CONFIGURABLE POCKET HOLSTER

(71) Applicant: Kevin Neal Spell, Winter Haven, FL (US)

(72) Inventor: Kevin Neal Spell, Winter Haven, FL (US)

( * ) Notice: Subject to any disclaimer, the term of this patent is extended or adjusted under 35 U.S.C. 154(b) by 0 days.

(21) Appl. No.: 16/727,935

(22) Filed: Dec. 27, 2019

(51) Int. Cl.
*A45F 5/02* (2006.01)

(52) U.S. Cl.
CPC ..... *A45F 5/022* (2013.01); *A45F 5/021* (2013.01); *A45F 2005/025* (2013.01); *A45F 2200/0575* (2013.01); *A45F 2200/0591* (2013.01)

(58) Field of Classification Search
CPC ..... A45F 5/021; A45F 2005/025; A45F 2200/0575; A45F 2200/0591
USPC ..... 224/250, 666, 901.2, 901.4, 148.6, 676, 224/677, 482; D3/215, 218, 303; 248/205.2
See application file for complete search history.

(56) References Cited

U.S. PATENT DOCUMENTS 4,022,361 A * 5/1977 Devlin ..... F41C 33/0209 224/192
4,420,104 A * 12/1983 Dilenno ..... A45F 5/021 224/250
D275,815 S * 10/1984 Dilenno ..... 224/250
4,915,337 A * 4/1990 Iwasaki ..... B60N 3/103 224/482
4,934,646 A * 6/1990 Doyle ..... A47F 5/0006 248/205.2
4,951,910 A * 8/1990 March ..... B60N 3/103 224/482
4,982,885 A * 1/1991 Severson ..... A45C 13/30 224/250
D314,277 S * 2/1991 Hackley ..... 224/250
D316,999 S * 5/1991 Sarff ..... 224/250
5,104,076 A * 4/1992 Goodall, Jr. ..... A45F 5/02 224/251
5,174,483 A * 12/1992 Moore, IV ..... A45F 5/02 224/250
5,325,991 A * 7/1994 Williams ..... A45F 5/02 215/12.1
D360,524 S * 7/1995 Snyder ..... D3/224
5,464,139 A * 11/1995 Schuchmann ..... A63B 55/10 224/247
5,535,928 A * 7/1996 Herring ..... A45F 5/021 224/250

(Continued)

*Primary Examiner* — Justin M Larson

(57) ABSTRACT

A universally configurable pocket holster includes a pocket clip having a U-shaped bend with integrally formed front and rear legs in overlying relationship from the U-shaped bend with one leg having a small aperture, a first horizontal traversing strap with first and second surfaces with one surface being substantially covered with one fastener component of a hook and loop material and the other surface is substantially covered with the other fastener component of a hook and loop material, a second perpendicular traversing strap with first and second surfaces being substantially covered with one fastener component of a hook and loop material and the other surface is substantially covered with the other fastener component of a hook and loop material, and a fastening point that forms an axis connecting the traversing straps, and the pocket clip allowing for the assembly to slightly rotate or swing from one side to the other.

1 Claim, 7 Drawing Sheets

(56) References Cited

U.S. PATENT DOCUMENTS 5,806,730 A * 9/1998 Deno ..... A45F 5/02 224/148.6
5,862,927 A * 1/1999 Tebeau ..... A61J 9/00 215/11.1
5,941,434 A * 8/1999 Green ..... A45F 5/02 224/195
5,964,386 A * 10/1999 Cote ..... A45F 5/02 224/236
6,182,878 B1 * 2/2001 Racca ..... A45C 15/00 224/236
6,264,079 B1 * 7/2001 Skaggs ..... F41C 33/0236 224/193
6,330,430 B1 * 12/2001 Jensfelt ..... H04B 1/3888 455/575.8
D462,521 S * 9/2002 Margo ..... D3/303
D464,792 S * 10/2002 Brown ..... D3/215
D467,069 S * 12/2002 TenHoeve ..... D3/218
8,573,458 B1 * 11/2013 Hamilton ..... A45F 5/021 224/674
D744,747 S * 12/2015 Hamilton ..... D3/218
D776,488 S * 1/2017 Brashears ..... D7/620
9,693,623 B2 * 7/2017 Bryant ..... A45C 11/00
10,123,642 B2 * 11/2018 Gazibara ..... A47G 23/0241
2001/0029170 A1 * 10/2001 Fujihashi ..... H04M 1/05 455/575.1
2003/0034366 A1 * 2/2003 Sloan ..... F41C 33/008 224/192
2005/0167458 A1 * 8/2005 Weiss ..... A45F 5/00 224/250
2008/0083803 A1 * 4/2008 Brantner ..... A45F 5/02 224/666
2013/0119098 A1 * 5/2013 Stiefel ..... A45F 5/021 224/183
2014/0263521 A1 * 9/2014 Hamilton ..... A45F 5/021 224/675

* cited by examiner

UNIVERSALLY CONFIGURABLE POCKET HOLSTER

CROSS REFERENCE TO RELATED APPLICATIONS

The present application claims the benefit of U.S. Provisional Application No. 62/786,212 entitled UNIVERSALLY CONFIGURABLE POCKET HOLSTER filed Dec. 28, 2018 by KEVIN NEAL SPELL, the disclosure of which is incorporated herein by reference.

FIELD OF INVENTION

The invention relates to holsters for articles carried in pockets and more specifically firearm ammunition magazines, flashlights, tools, knives and numerous other items used in the field of self defense, law enforcement, camping, hiking, and shooting sports that can be carried in a pocket.

BACKGROUND OF THE INVENTION

Users of articles that are small enough to fit into pockets of clothing, typically place the articles into the pockets loosely allowing the articles to shift and move around according to the size and style of the pocket that the article was placed in. Articles that are carried in the pocket may not be quickly accessible to the user, who may have to reach further into larger pockets to retrieve the article as an example. The article may have also shifted or changed position from when it was originally placed into the pocket by the user, thus requiring more effort on the part of the user to retrieve the article and orient it to the desired position. The use of a pocket along with the quick retrieval and ease of retrieval of an article that is properly oriented being carried is especially important to users who carry weapons and firearm ammunition magazines for defensive purposes.

In addition, articles that would be appropriate for carrying in a pocket vary greatly in size and shape. Some examples of articles appropriate for carry in a pocket but varying in size would be pocketknives, small flashlights, cell phones, firearm ammunition magazines, and firearm revolver speed loaders to name a few. A user, who wanted to carry a particular article like a firearm ammunition magazine in a properly positioned, easily accessible position, and properly oriented would have to purchase from manufactures a size specific pouch or holster for the magazine so that it fit properly. Currently there are many manufactured examples of holsters and pouches that carry some of the mentioned articles like firearm ammunition magazines on a user's body, some mounted on belts and some carried in pockets in a concealed manner, but they are fitted to certain sized manufactured articles. These manufactured examples are made specifically to fit the article or firearm ammunition magazine in question, being constructed mostly of a rigid molded plastic, metal materials, leather, or a fitted semi pliable man-made material. As a result, the user must purchase a pouch or holster for each article or firearm ammunition magazine that the user intends on carrying due to the above construction materials being used. Furthermore, users who are skilled with weapons for defensive purposes may have need of different articles, weapons, or firearm ammunition magazines to be worn for different occasions that support the main defensive firearm that they are carrying. Thus, users must purchase several different types and sizes of pouches or holsters in order to fulfil these requirements.

As mentioned previously there am many manufactured article holsters and some even designed to fit in a user's pocket. However, these are made of rigid materials like plastic, kydex, metal, and even leather to name a few. These harder materials create a hard and rigid shape that the user carries in their pocket. This rigid and hard shape is not comfortable, not pliable, and usually does not bend or give along with the flexibility of the pocket that the holster is carried in. This is especially relevant to different positions that a user may be in like standing and sitting to name a few.

Therefore, there is a need for an improved holster that fits into a pocket of a user, is fixed into position with the use of a clip preventing the article from falling further into deeper pockets, is easily configurable and reconfigurable to carry any of the wide variety of articles or firearm ammunition magazines mentioned, is made of a softer more pliable material allowing the holster to flex while being carried providing the ability to adjust to different pocket positions and all of this accomplished with the use of a single pocket holster to keep down cost to the user.

BRIEF SUMMARY OF THE INVENTION

In one embodiment of the invention a universally configurable pocket holster is provided, comprising of a pocket clip having a U-shaped bend in its upper end region and having spaced integrally formed front and rear legs that depend in overlying relationship from the U-shaped bend, with one leg having a small aperture. A first horizontal traversing strap includes a flexible strap with first and second surfaces. One surface of the first horizontal traversing strap is substantially covered with one fastener component of a hook and loop fastener material and the other surface is substantially covered with the other fastener component of a hook and loop fastener material. This first horizontal strap is formed into a sleeve of a size and shape to hold an article around its circumference or outer surface. A second perpendicular traversing strap includes a flexible strap with first and second surfaces. One surface of the second perpendicular traversing strap is substantially covered with one fastener component of a hook and loop fastener material and the other surface is substantially covered with the other fastener component of a hook and loop fastener material. This second perpendicular traversing strap extends to encompass the bottom portion of the carried article folding back up and onto the first horizontal traversing strap. A fastening point that forms an axis connecting the first horizontal traversing strap, the second perpendicular strap, and the pocket clip allowing for the pocket holster assembly to slightly rotate or swing from one side to the other while being carried.

DETAILED DESCRIPTION OF THE INVENTION

Figure 1:
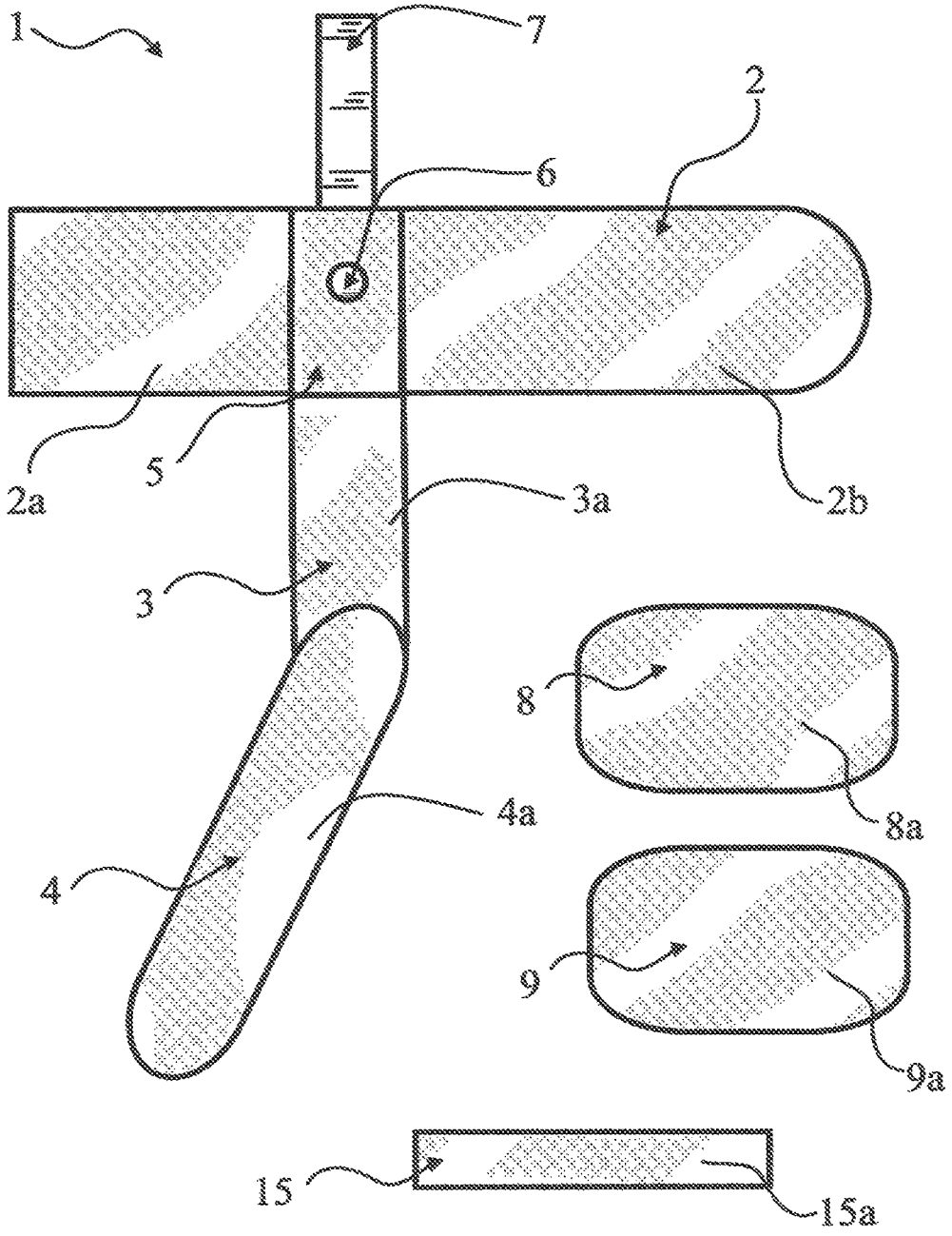
FIG. 1 illustrates the components of a preferred embodiment pocket holster, as it is laid out from the front open receiving end of a pocket holster, in an unwrapped orientation.

The present invention provides a pocket holster that is configurable and reconfigurable to hold the plurality of articles that a user would carry in a pocket in a manner in which would make the article more secure, positioned for ease of use, quickly retrievable for different purposes, and be flexible for comfortable carry. The present invention is described in enabling detail in the following examples, which may represent more than one embodiment of the present invention.

The present invention is a size adjustable pocket holster, of a preferred embodiment 1, constructed as such having the ability to be form fitted or wrapped around the circumference or outer surface of a plurality of articles 10, that are intended to be stored in a pocket, to keep them held in place. Furthermore not just fitted or wrapped around the circumference or outer surface for holding the article 10 in place, but also fitted or wrapped around a plurality of lengths of the article 10 in order to control the depth of which the article 10 is held in place in the pocket holster, relative to the opening of a selected pocket 13 used by a user. The form fitting or wrapping capabilities of the pocket holster result in it being made of flexible and softer materials for ease of use and comfort while being carried. The pocket holster also is constructed in a way that allows the pocket holster to swing from side to side in an exhibited side to side movement 14, while being placed in a pocket 13 so that it moves along with the pocket variances for the comfort of the user.

FIG. 1 illustrates the components of a preferred embodiment pocket holster 1, as it is laid out from the front open receiving end of a pocket holster, in an unwrapped orientation. The preferred embodiment pocket bolster 1, illustrated in FIG. 1, shows the interior surfaces of a first horizontal traversing strap short hook side 2*a*, a first horizontal traversing strap long hook side 2*b*, a second perpendicular traversing strap hook side 3*a*, a third perpendicular traversing strap hook side 4*a*, a spacing strap 5, a first reinforcing strap hook side 8*a*, a second reinforcing strap hook side 9*a*, and a article engagement strap hook side 15*a* all with a hook side component of hook and loop fastening material engaging towards the surface of any article 10 to be carried. In this example the strap components are made of Velcro© One Wrap material. The hook side of these covered surfaces is able to substantially grip the plurality of article 10 surfaces more effectively than the loop side of the covered surfaces on the straps used in this preferred embodiment pocket bolster 1. FIG. 1 of this embodiment shows the open interior portion of the pocket bolster in its unwrapped orientation and its other non-fastened strap components of which their exposed surfaces are covered with the hook component of the book and loop material.

Figure 3:
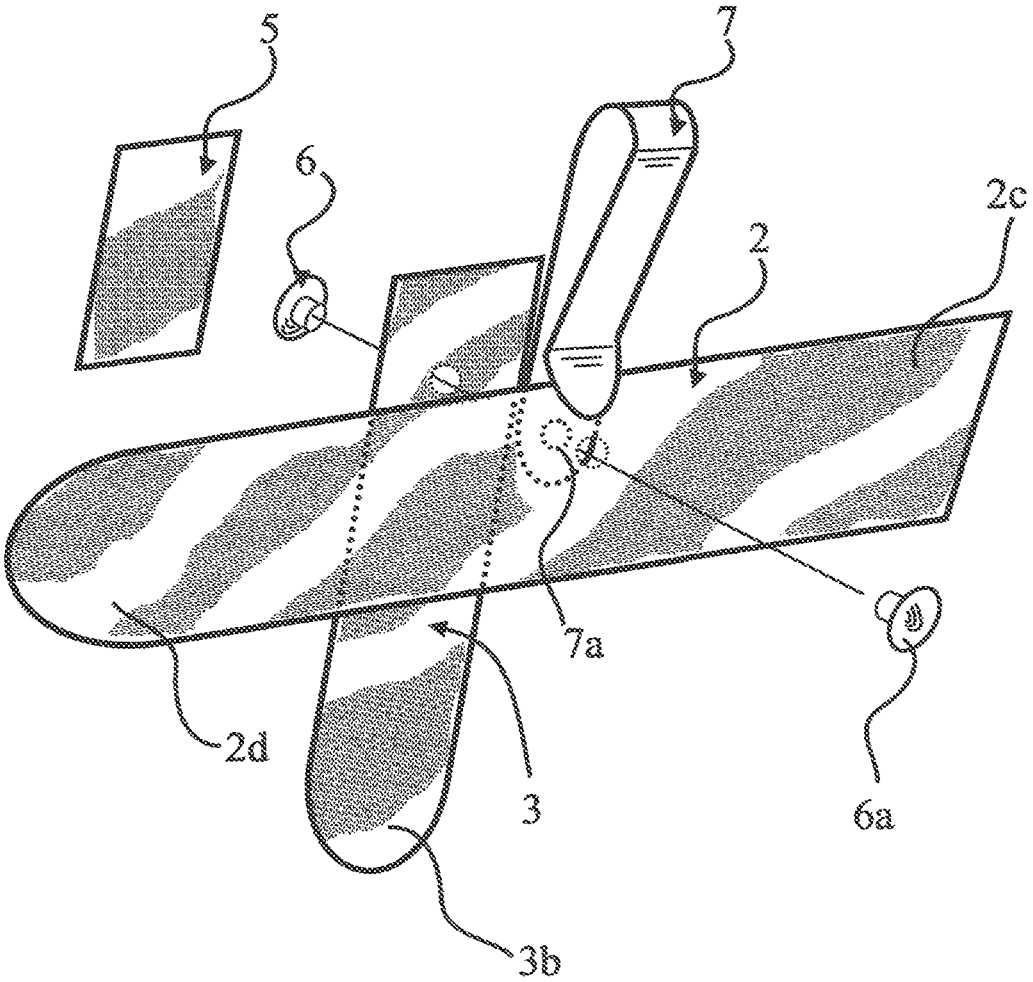
FIG. 3 illustrates an exploded view of the main assembled body and its components of one embodiment shown.

Also illustrated in this preferred embodiment pocket holster 1 in FIG. 1, are the component straps that are non-fastened to the four-basic fastened together components as shown in FIG. 3 as an example. These are: a third perpendicular traversing strap 4, a first reinforcing strap 8, a second reinforcing strap 9, and an article engagement strap 15. These non-fastened strap components are all also made of Velcro© One Wrap material in this preferred embodiment but other materials could be used by any practitioner in the textile arts. All of these non-fastened strap components are used to expand the size adjustable capabilities of the four-basic fastened together components as illustrated in FIG. 3. As with the third perpendicular traversing strap 4, it can be cooperatively engaged onto a second perpendicular traversing strap 3 in order to extend its length to suit the length of the article 10 being carried. After cooperative engagement onto the second perpendicular traversing strap 3, the lose end of the third perpendicular traversing strap 4 with its hook side 4*a* can be cooperatively engaged onto the loop side of a first horizontal traversing strap 2 loop side. In doing so the user while engaging the third perpendicular traversing strap 4 onto the second perpendicular traversing strap 3 can adjust how deep or the depth of which the article 10 being engaged by the pocket holster is in the pocket 13 that it is carried in. This deepness or depth adjustment is of importance to the user who wants to quickly access the article 10 especially for means of self defense.

Likewise, the other non-fastened strap components described as the first reinforcing strap g and second reinforcing strap 9, are comprised of two sides of the same hook and loop material. The user of this preferred embodiment pocket holster 1 can engage reinforcing straps onto the pocket holster in order to further stabilize or reinforce the cooperatively engaged surfaces of the traversing straps. This is done by engaging either of the hook surfaces of the first reinforcing strap hook side 8*a* or the second reinforcing strap hook side 9*a* onto any exterior loop component of the fully configured engaged mode of the pocket holsters loop side. It will also be appreciated that any suitable form of yieldable or releasable surface mounted materials equivalent in function to hook and loop materials could be advantageously used. Moreover, a variety of straps in size, shape and number could be used. Further, in some embodiments of the invention, certain regions of a given surface may include hook components, while other adjacent regions may include loop components (or other pairs of complementary cooperative components). Also, it will be appreciated that the juxtaposition of any component of the hook and loop material can be switched or reversed, and that such materials could be limited on a surface of any strap only to the area needed to provide the universal configuration range desired.

As can be seen in the illustrations in FIG. 1, the components of this preferred embodiment pocket holster 1 are cut to various lengths and widths according to the best specifications to engage the targeted plurality of article 10 sizes that would be engaged. The present invention may comprise any number of straps, cut and provided with any suitable form for connection together to tightly wrap and precisely fit a wide variety of articles 10, while being releasable for refitting to other articles 10 of varying dimension, shape and size with similar secure fit, providing a user-formed pocket holster more precisely and advantageously than previously available devices non-conformable by the user. Strap size and shape variations are easily provided to accommodate these varieties by any practitioner skilled in the arts.

Figure 2:
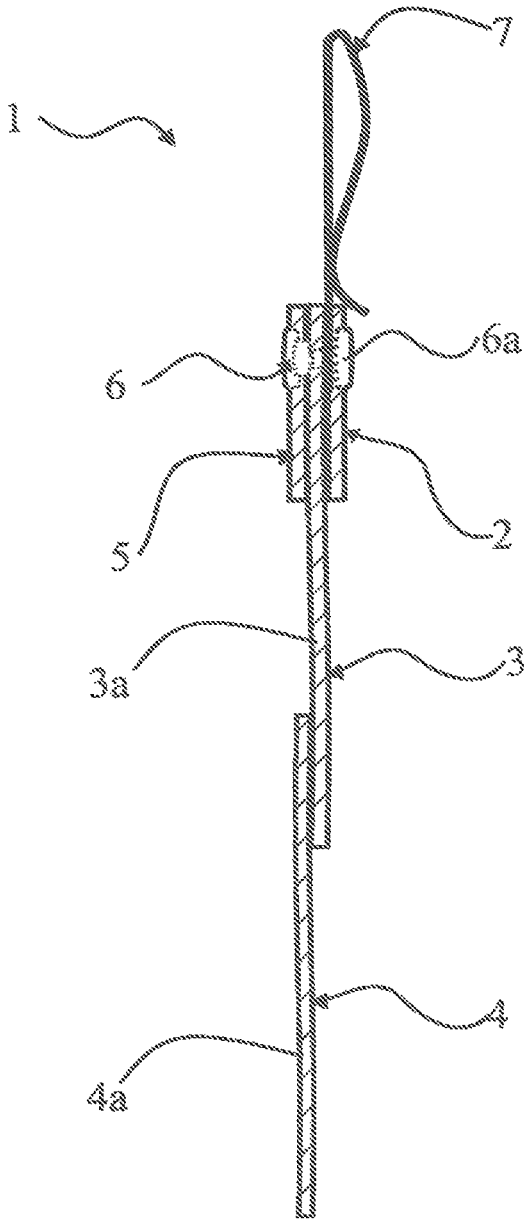
FIG. 2 illustrates a cross-sectional view of one embodiment of a main assembled body with a non-fastened strap component.

FIG. 2 illustrates a cross-sectional view of one embodiment of a main assembled body with a non-fastened strap component. FIG. 2 of this embodiment shows a cross section view of a preferred embodiment pocket holster 1 and as it is illustrated with the interior engaging side, on the side with the fastening point 6, as substantially covered with a hook component of a hook and loop material. The exterior or rear surfaces, of the preferred embodiment pocket holster 1 are substantially covered with a loop component of a hook and loop material. This is represented in FIG. 2 as the side of the cross section with the second receiving fastening point 6*a*. Furthermore, for reference, FIGS. 3, 4, 5, 6, 7 shows the preferred embodiment pocket holster 1 from its exterior or rear view thus these illustrated surfaces are all substantially covered with a loop component of a book and loop material. As seen in FIG. 2, the third perpendicular strap 4 is shown cooperatively engaged onto the second perpendicular strap 3 in order to extend the length of the second perpendicular strap in order to extend the depth that an article 10 can be positioned while being carried by a user. As shown in this example strap sizes, shape variations, and order of placement in relation to an article 10, are easily provided to accommodate the many varieties by any practitioner skilled in the arts, however it will be appreciated that the juxtaposition of any component of the hook and loop straps can be switched or reversed, and that such straps could be limited on a surface of any strap only to the area needed to provide the universal configuration range desired.

FIG. 3 illustrates an exploded view of a main assembled body and its components of one embodiment shown. The present embodiment of the invention is made up of four-basic fastened together components, best seen in appreciation from FIG. 3. These are: a pocket clip 7, a first horizontal traversing strap 2, a second perpendicular traversing strap 3, and a fastening point 6 combined with a second fastening point 6*s*. Both the first horizontal traversing strap 2 and second perpendicular traversing strap 3 are made of a hook and loop fastening material, with one side being covered with the loop fastening material and the other side being covered with the hook fastening material. The first horizontal traversing strap 2 and second perpendicular traversing strap 3 we made of Velcro© One Wrap material, in this preferred embodiment, but other materials could be used by any skilled practitioner in the textile arts. The pocket clip 7 is of a type that has a substantially U-shaped bend in its upper end region, and having spaced integrally formed front and rear legs that depend in overlying relationship from the U-shaped bend, with one leg having a small aperture 7*a* and able to clip onto the leading surface of a pocket 13. The pocket clip 7 can be manufactured with any rigid material capable of supporting the weight of the articles 10 to be held, in this preferred embodiment the pocket clip 7 is made of a spring steel metal, allowing for it to hold its place on the leading surface of a pocket 13. The pocket clip 7 is fastened to the first horizontal traversing strap 2 and to the second perpendicular traversing strap 3 by means of a fastening point 6. A complete fastening point 6 and 6*a*, in this preferred embodiment, is a metal double cap rivet consisting of two main parts. The first part of the fastening point 6 is attached to its second fastening point 6*a* by mechanical means. The fastening point 6 and its second fastening point 6*a* are pressed in through a small aperture 7*a* in the pocket clip 7, continuing through the first horizontal traversing strap 2, and continuing through the second perpendicular traversing strap 3 in a fashion like how common rivets are set. Although the fastening point 6 in this example, is described as being a two-part metal double cap rivet, any other fastening material, shape, style, single or multiple component fastening material can be used by anyone skilled in the art. As further shown in FIG. 3, a spacing strap 5 can be used to help with conformity of the fastening point 6 and add further surface area for articles 10 to engage on when inserted into the preferred embodiment pocket holster 1. In this preferred embodiment pocket holster 1 the four basic fastened together components are shown in a certain order, however it will be appreciated that the juxtaposition of any component of the book and loop straps can be switched or reversed, and that such straps could be limited on a surface of any strap only to the area needed to provide the universal configuration range desired.

Figure 4:
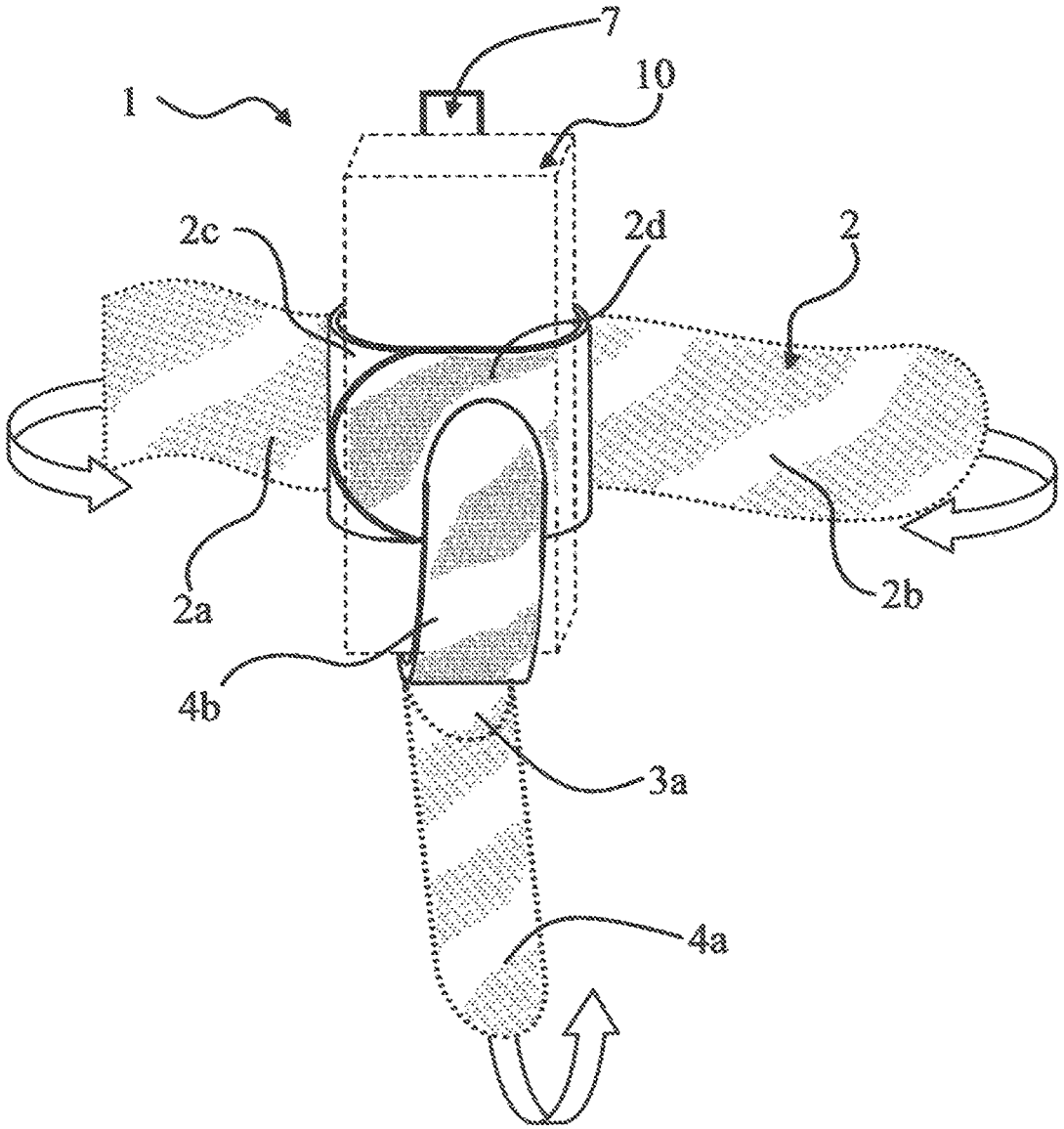
FIG. 4 illustrates the front view of one embodiment in an engaged mode of the pocket holster carrying an article, the pocket holster straps are shown in phantom prior to being engaged or wrapped on the article.

FIG. 4 illustrates the front view of one embodiment in an engaged mode of the pocket holster carrying an article 10. The pocket holster straps we shown in phantom prior to being engaged or wrapped on the article 10. As can be seen in FIG. 4 the present invention in its preferred embodiment is in its engaged mode fitted or wrapped around an article 10. This preferred embodiment is fitted or wrapped around the article 10 by the user as desired to best fit an article 10. With the four-basic fastened together components the pocket holster is substantially T-shaped as shown in FIG. 1. A desired article 10 is placed into the center of the unfolded pocket holster against the hook surfaces of its interior. If the spacing strap 5 was used in the assembly, then the article would rest on it first. Next the user would use the first horizontal traversing strap 2 to begin a fitting or wrapping sequence. Preferably the first horizontal traversing strap short hook side 2*a* would be first formed onto the corresponding surface of the article being held. The user while holding the first horizontal traversing strap short hook side 2*a* in place, would then use the first horizontal traversing strap long hook side 2*b* to fit back over the first horizontal traversing strap short hook side 2*a*, cooperatively engaging its now exposed first horizontal traversing strap short loop side 2*c*. This first horizontal traversing strap 2 will now form a sleeve for the circumference or outer surface of the article 10 being held. Next the user will begin fitting or wrapping the second perpendicular traversing strap 3 onto the article's 10 length portion that is extending below the first horizontal traversing strap 2. If the second perpendicular traversing strap 3 was not long enough to be fitted or wrapped around the length of the article 10, then the user could use the additional non-fastened strap component third perpendicular traversing strap 4 to complete the process. This would now result in the book side of the second perpendicular strap hook side 4*a* to cooperatively engage the now exposed loop side of the first horizontal traversing strap long loop side 2*d*. The user has now fitted the pocket holster to the article 10. If the user decides to use either or both the first reinforcing strap g and second reinforcing strap 9, it would be placed hook side down to cooperatively engage the exposed loop side of the straps preferably at the traversing points.

Figure 5:
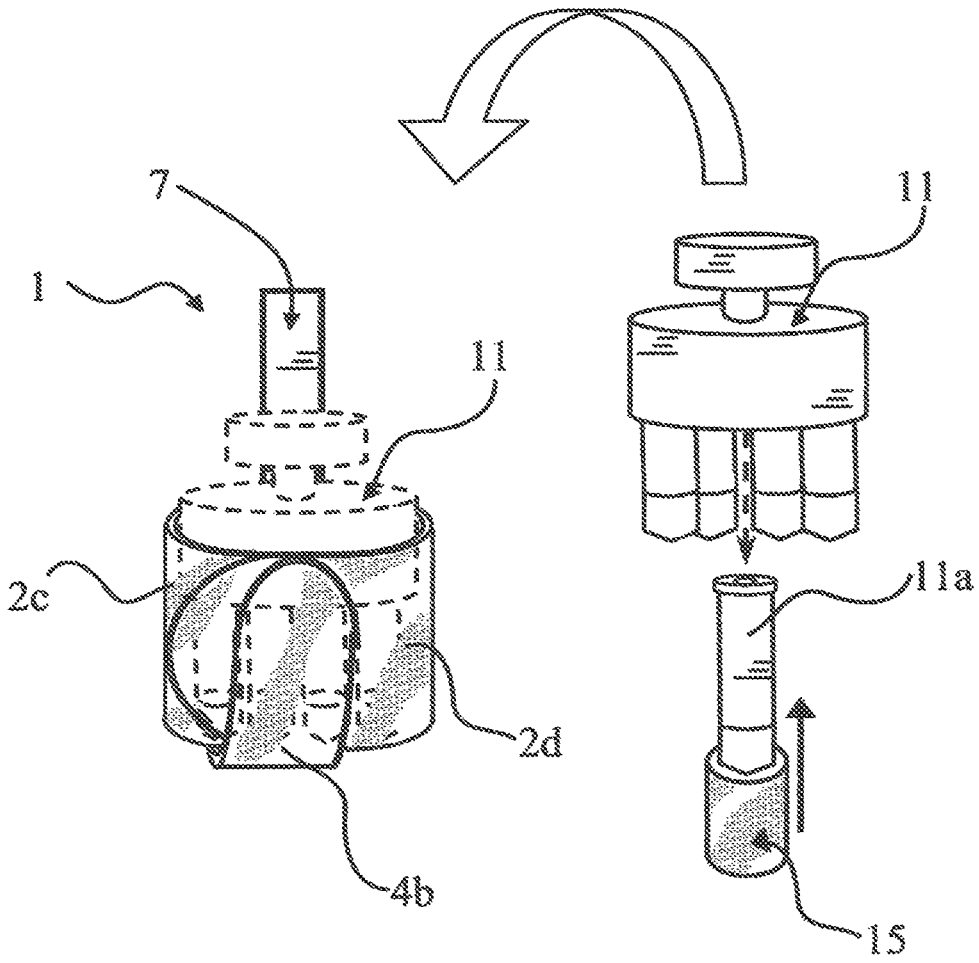
FIG. 5 illustrates the font view of an engaged or wrapped mode of one embodiment of the invention carrying a firearm revolver speed loader, the firearm revolver speed loader is shown prior to engagement as a separate embodied component of the invention is used to wrap an individual firearm ammunition cartridge.

FIG. 5 illustrates the front view of one embodiment an engaged or wrapped mode of the pocket holster 1 carrying a firearm revolver speed loader 11. The firearm revolver speed loader 11 is shown prior to engagement as a separate embodied component of the holster is used to wrap an individual firearm ammunition cartridge. The user concerned with a means of self defense will also have use of articles 10 that are significantly shaped like a firearm revolver speed loader 11 as illustrated in FIG. 5. The article engagement strap 15, in this preferred embodiment shown in FIG. 5, is fitted or wrapped around an individual firearm ammunition cartridge 11*a* that is held by the firearm revolver speed loader 11. As mentioned with the other non-fastened strap components the article engagement strap hook side 15*a* is engaged towards the surface of the individual firearm ammunition cartridge 11*a* to substantially grip it. FIG. 5 shows this preferred embodiment process in order to properly grab the firearm revolver speed loader 11 as it is placed into the pocket holster. Since the article engagement strap hook side 15*a* is engaging the individual firearm ammunition cartridge 11*a*, that now exposes the straps other side of loop component listed as engagement strap loop side 15*b*. This exposed loop side of the article engagement strap 15*b*, will now be cooperatively engaged onto the interior hook surfaces of the preferred embodiment pocket holster 1 as seen in FIG. 1 so that the firearm revolver speed loader 11 can be secured in a more stable position.

Figure 6:
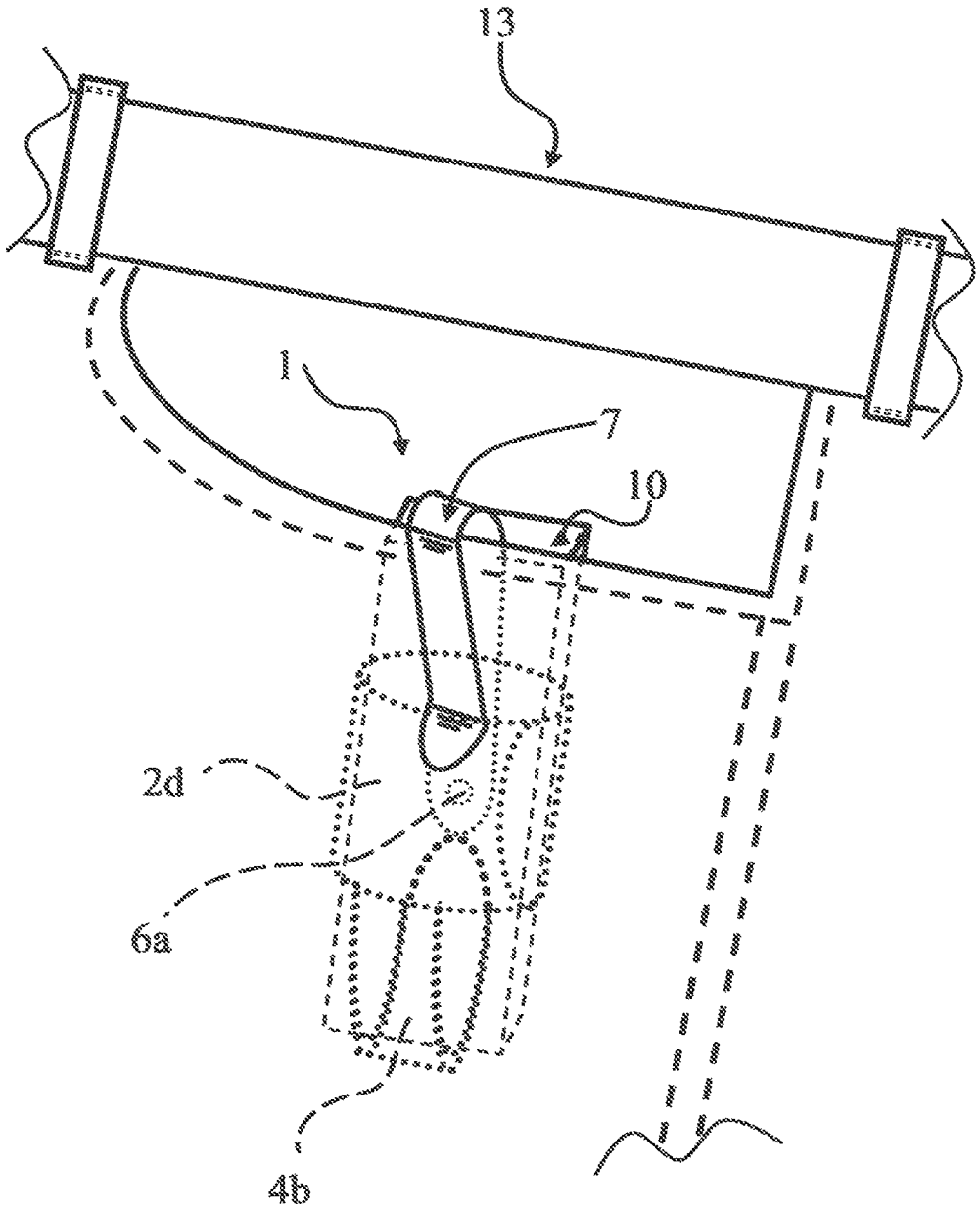
FIG. 6 illustrates a rear view of the pocket holster of this embodiment fully configured carrying an article and worn inside a pocket.

FIG. 6 illustrates a rear view of the pocket holster of this embodiment fully configured carrying an article and worn inside a pocket 13. The last step of the fitting or wrapping sequence would involve the user placing the pocket holster in its engaged mode into a pocket 13. The preferred embodiment pocket holster 1 is fully ambidextrous and can be placed in any pocket chosen by the user. The user would place the pocket holster into the selected pocket 13 allowing the pocket clip 7 to engage over the leading edge of the pocket 13, holding the pocket holster in place once placed the pocket holster would be concealed from view leaving only the top outside portion of the pocket clip 7 exposed. If the user fitted or wrapped the article 10 correctly, the article 10 would remain concealed from view. The resulting placement would keep the article 10 within quick and easy access to the user, who would simply reach in with fingers to grasp the top of the article 10 withdrawing it out of the pocket 13. The force needed to withdraw the article 10 from the pocket holster is substantially controlled by the fitting or wrapping sequence completed by the user, specifically to how the first horizontal traversing strap 2 was fitted or wrapped around the circumference of the article 10. This fitting or wrapping of the article's circumference can be done with either tight tolerances or loose tolerances according to the desire of the user.

Figure 7:
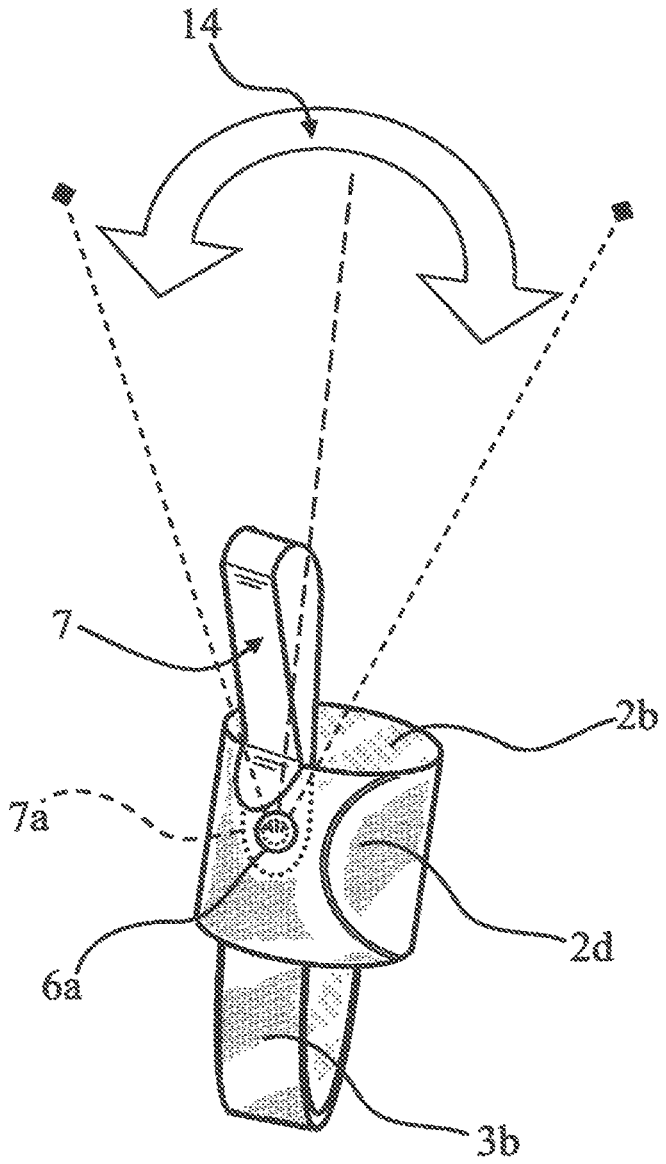
FIG. 7 illustrates a rear view of the pocket holster of this embodiment fully configured, it also illustrates how from the fastener point that the embodied pocket holster exhibits side to side movement.

FIG. 7 illustrates a rear view of the pocket holster of this embodiment fully configured. It also illustrates how from the fastening point 6 that the pocket holster exhibits side to side movement 14. With the pocket holster now in its engaged mode and placed into a selected pocket 13, the preferred embodiment pocket holster 1 will exhibit flexibility and a side to side movement as demonstrated in FIG. 7. In this current preferred embodiment, the majority of the components of the pocket holster am made of Velcro© One Wrap material which is flexible and pliable. The user who withdraws the article 10 from the pocket 13 would leave the attached pocket holster in place, while using the article 10. The preferred embodiment pocket holster 1 in its empty state would still hold its dimensionally established shape, based on the article 10 that it was fitted or wrapped around. However, the now empty pocket holster would be able to flex or collapse in the pocket 13 for comfort as the pocket 13 of the user is moved or pressed closed. Accordingly, the article 10 can then be replaced into the pocket holster at the desire of the user, with proper manipulation, resuming the fitted or wrapped state that it was in initially. In addition to the flexibility and pliability of the materials used in this preferred embodiment pocket bolster 1, there am the benefits of an exhibited side to side movement 14 resulting from the four-basic fastened together components as seen in FIG. 3. Specifically, is the use of a complete fastening point 6, 6*a*, through an open aperture 7*a* of pocket clip 7. This fastening point forms an axis point that allows for the main body of the pocket holster to rotate slightly from side to side as shown in FIG. 7. This exhibited side to side movement 14 allows the pocket holster to move and position itself along with the pocket 13 that it was placed in. This is more evident if the pocket 13 chosen was a front pants pocket of which it would collapse and bend while being worn by the user, especially in a seated type position.

While preferred embodiments of the present invention have been illustrated and described in detail, it is apparent that other modifications and variations thereto are possible, all of which fall within the true spirit and scope of the invention. Therefore, the foregoing is intended only to be illustrative of the principles and preferred components of the present invention. Further, since numerous modifications and changes will readily occur to those skilled in the art, it is not intended to limit the present invention to the exact construction, materials, and fitting or wrapping sequences described. Accordingly, all suitable modifications and equivalents may be included and considered to fall within the scope of the invention.

What is claimed is:

1. A universally configurable pocket holster, comprising:

a pocket clip having a U-shaped bend in its upper end region, and having spaced integrally formed front and rear legs that depend in overlying relationship from the U-shaped bend, with one leg having a small aperture;

a first horizontal traversing strap includes a flexible strap with first and second surfaces, one surface of the first horizontal traversing strap is substantially covered with one fastener component of a book and loop fastener material and the other surface is substantially covered with the other fastener component of a hook and loop fastener material, the first horizontal strap is formed into a sleeve of a size and shape to hold an article around its circumference or outer surface;

a second perpendicular traversing strap includes a flexible strap with first and second surfaces, one surface of the second perpendicular traversing strap is substantially covered with one fastener component of a hook and loop fastener material and the other surface is substantially covered with the other fastener component of a hook and loop fastener material, this second perpendicular traversing strap extends to encompass the bottom portion of the carried article folding back up and onto the first horizontal traversing strap; and a fastening point that forms an axis connecting the first horizontal traversing strap, the second perpendicular strap, and the pocket clip allowing for the pocket holster assembly to slightly rotate or swing from one side to the other while being carried.

* * * * *